US011142443B2

(12) United States Patent
Clüsserath

(10) Patent No.: US 11,142,443 B2
(45) Date of Patent: Oct. 12, 2021

(54) METHOD AND FILLING SYSTEM FOR FILLING CONTAINERS

(71) Applicant: KHS GmbH, Dortmund (DE)

(72) Inventor: Ludwig Clüsserath, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 154 days.

(21) Appl. No.: 15/745,201

(22) PCT Filed: Jul. 4, 2016

(86) PCT No.: PCT/EP2016/065741
§ 371 (c)(1),
(2) Date: Jan. 16, 2018

(87) PCT Pub. No.: WO2017/009091
PCT Pub. Date: Jan. 19, 2017

(65) Prior Publication Data

US 2019/0010039 A1 Jan. 10, 2019

(30) Foreign Application Priority Data

Jul. 16, 2015 (EP) ..... 102015111536

(51) Int. Cl.
*B67C 3/28* (2006.01)
*B67C 3/00* (2006.01)
*B67C 3/12* (2006.01)

(52) U.S. Cl.
CPC ..... *B67C 3/286* (2013.01); *B67C 3/007* (2013.01); *B67C 3/12* (2013.01); *B67C 3/287* (2013.01)

(58) Field of Classification Search
CPC ..... B67C 3/12; B67C 3/286; B67C 3/287; B67C 3/007; B67C 3/28–288
See application file for complete search history.

(56) References Cited

U.S. PATENT DOCUMENTS 4,407,379 A * 10/1983 Pryor ..... G01G 13/04 177/103
5,031,673 A * 7/1991 Clusserath ..... B67C 3/004 141/6
5,313,990 A * 5/1994 Clusserath ..... B67C 3/10 141/147

(Continued)

FOREIGN PATENT DOCUMENTS

DE 197 41 254 11/1998
DE 699 17 330 5/2005

(Continued)

*Primary Examiner* — Timothy L Maust
(74) *Attorney, Agent, or Firm* — Occhiuti & Rohlicek LLP

(57) ABSTRACT

Using a filling point to fill a container with liquid filling-material fed by a supply line through which filling material at a supply-line pressure is made available for filling the containers includes using a control circuit to regulate flow velocity at which filling material flows into the container by opening a liquid valve, opening a regulating valve upstream of the liquid valve, sensing flow velocity of the filling material, comparing the flow velocity with a target flow velocity, and using the regulating valve to regulate the flow velocity such that the flow velocity is independent of a pressure difference between the supply-line pressure and a filling pressure set in the container.

29 Claims, 3 Drawing Sheets

(56) References Cited

U.S. PATENT DOCUMENTS

| | | | | |
|---|---|---|---|---|
| 6,375,050 | B1 | 4/2002 | Gruson | |
| 7,866,123 | B2 * | 1/2011 | Clusserath | B67C 3/225 53/202 |
| 2010/0212773 | A1 * | 8/2010 | Clusserath | B67C 3/10 141/6 |
| 2013/0220481 | A1 * | 8/2013 | Hartel | B67C 3/045 141/9 |
| 2013/0333800 | A1 * | 12/2013 | Cocchi | B67C 3/007 141/192 |

FOREIGN PATENT DOCUMENTS

| | | |
|---|---|---|
| DE | 10 2006 033 111 | 1/2008 |
| DE | 10 2009 016 084 | 5/2011 |
| WO | WO98/049089 | 11/1998 |
| WO | WO2014/206774 | 12/2014 |

* cited by examiner

METHOD AND FILLING SYSTEM FOR FILLING CONTAINERS

RELATED APPLICATIONS

This application is the national stage under 35 USC 371 of international application PCT/EP2016/065741, filed on Jul. 4, 2016, which claims the benefit of the Jul. 16, 2015 priority date of German application DE 10-2015-111-536.0, the contents of which are herein incorporated by reference.

FIELD OF INVENTION

This invention relates to filling systems, and in particular, filling of beverage containers.

BACKGROUND

In a typical filling system, filling material fills a filling-material tank up to some level. This level varies over time as containers are filled and new filling material is added. The hydrostatic pressure, or filling pressure, is thus constantly changing.

The flow velocity at which the filling material flows into is determined at least in part by the filling pressure, and hence by the filling-material level in the tank. Thus, the flow velocity is also constantly changing.

In pressure filling systems, a container is sealed against a filling element. In such filling systems, a throttle valve adjusts the flow velocity. This throttle valve reduces the flow velocity to some value that is below the maximum value that could be attained given the current filling-material level. However, as the filling-material level is constantly changing, the pressure and hence flow velocity is constantly changing.

During pressure filling, it is fill a container with an inert gas at some relatively high preloading pressure. A difficulty that arises is that the preloading pressure and the filling pressure are independent of each other. This means that the preloading pressure must very accurately track the filling pressure so as to maintain a desired flow velocity. This makes it difficult to control flow velocity and volumetric flow rate.

SUMMARY

It is an object of the invention to provide a method and apparatus for filling containers in which the filling speed is independent of the difference between the level of the filling material surface in a filling material tank and the level of the filling-material delivery opening at the filling point, and in particular also independent of pressure in a filling-material feed.

In the embodiments described herein, a control circuit controls the filling speed, i.e. the flow velocity at which the filling material flows to the container during filling. The pressure of the filling material in the product feed or product supply line, or a pressure difference between the pressure of the filling material in the product feed or product supply line and the pressure in the container, i.e. the filling pressure or preloading pressure, has essentially no influence on the control function. The pressure of the filling material in the product feed or product supply line is reduced to a filling pressure in the container, which is independent of the pressure and/or which is freely selectable and so which can be optimally selected preferably depending on the particular filling method and/or depending on the nature of the filling material and/or containers. The height difference is thus irrelevant or essentially irrelevant for the filling speed.

The control circuit comprises a volumetric-flow-rate control element through which filling material flows towards at least one filling point. This flow can be continuous or incremental. The volumetric-flow-rate control element facilitates regulating the volumetric flow rate. An electric or electronic governor can thus modify the volumetric flow rate of the filling material, i.e. the quantity of filling material flowing through the volumetric-flow-rate control element per unit of time.

The control circuit also comprises a sensor device to detect the volumetric flow rate of the filling material that is actually being fed to the filling point and to transmit, to the governor, a corresponding sensor signal as a measured value of the filling speed. The setting of the volumetric-flow-rate control element and hence the regulating of the volumetric flow rate are then effected by way of processing, for example by comparing the particular measured value with at least one target value of the filling speed. The measured value, i.e. the actual flow velocity of the filling material, can be calculated from the data supplied by the sensor device. Alternatively, the data supplied by the sensor device already indicates the velocity of the filling material, i.e. the measured value.

The target value preferably takes account of the nature of the particular filling material one or more factors singly or in combination. These factors include the type of container to be filled, the container's capacity, its size, and its shape. These factors also include the type of filling process. Examples of such types of filling processes include pressure-filling, pressureless filling, open-jet filling, filling methods that use long-tube filling systems, and filling methods in which filling material is introduced into the container as a flow film over the container's inner wall. Additional factors that can be taken into account include product-specific factors. The target value is therefore a product-specific, container-specific, and/or method-specific profile.

As used herein, a "target value" does not necessarily mean a single number. A "target value" can mean a time-varying function in which different flow rates occur at different times. This will also be referred to as a "profile" or "target profile," a "time characteristic," or a "time profile." For example, it may be useful to have a slow flow rate at first followed by a faster flow rate later.

The desired or required filling speed can be maintained with great precision by regulating the flow using the control circuit. In particular, a significant improvement in the number of containers filled per unit of time can also be achieved by taking account of the nature of the filling material, the containers, and/or of the filling method. Through dynamic regulation as described herein, it is possible to compensate in real time for any changes of pressure, either in the filling material and/or in the preloading gas. As a result, these changes will not significantly affect filling speed. Instead, the control circuit regulates flow to compensate for these changes.

In the apparatus described herein, the flow velocity of the filling material flowing to the container, and hence the filling speed, results from the pressure difference between the pressure of the supplied filling material and the pressure inside the container.

Examples of a volumetric-flow-rate control element include a controllable throttle valve or a flow control valve. Examples of a sensor device that detects the volumetric flow rate include a flow meter through which the filling material flows. Examples of flow meters include a magnetic-inductive flow meter (MID) and a mass flow meter.

One advantage of the invention is that, with the filling system, despite it exactly maintaining a specified or desired filling speed, a filling material tank and in particular a partly filled filling-material tank can be dispensed with altogether, it being instead possible to feed the filling material under pressure to the individual filling points, or to the filling devices or filling blocks which form these filling points, through a common product supply line or a common product supply channel without the presence of a gas volume or gas buffer in this supply line or supply channel. Among other advantages, the fact that the invention obviates the need for a filling-material tank results in a design simplification and cost saving for the filling system, and in particular eliminates the risk of the filling material being contaminated by bacteria, especially on an exposed filling-material surface.

To enable regulating with a sufficiently wide regulating range, the pressure of the supplied filling material is preferably set so that it lies above the filling pressure, for example 0.5-3.0 bar above the filling pressure, at which the filling material is delivered into the container at the particular filling point. The preloading pressure or filling pressure of a preloading gas that is used when pressure-filling the containers is less than the pressure of the supplied filling material.

As pressure fluctuations are compensated by the regulating function and so basically do not affect the filling speed, there is no need for pressure sensors for monitoring and/or regulating the filling pressure and/or preloading pressure, in particular, at the filling devices or filling blocks within the control circuit that form the individual filling points.

In a preferred embodiment of the filling system, a liquid valve, which is configured for example as an open/close valve and which opens at the start of the filling phase and closes at the end of the filling phase, i.e. after the desired filling material height or filling material quantity in the container is attained, namely for example in response to a signal from a probe that reaches into the container during filling and/or from a weighing device that detects the weight of the containers and/or from a flow meter that in this case for example is the flow meter of the control circuit as well, is located in the direction of flow of the filling material upstream of the mouth or of at least one filling-material delivery opening of each filling point. To start the filling phase the liquid valve associated with the particular filling point is now opened and simultaneously or with a slight delay, for example with a delay of 25-80 milliseconds or with a delay of 25-50 milliseconds, the volumetric-flow-rate control element arranged upstream of the liquid valve when viewed in the direction of flow of the filling material is also opened if before the start of the filling phase it was in a state blocking the filling material. However it is also possible to use the respective liquid valve as a volumetric-flow-rate control element and for this purpose to configure it as a flow control valve that again enables the volumetric flow rate to be regulated continuously or incrementally.

The control circuit or the elements forming it are for example provided discretely for each filling point or in common for a plurality of filling points, and so form filling devices or filling blocks, e.g. having additional controllable gas-paths that are also provided discretely for each filling point or in common for a plurality of filling points. These can then be mounted and/or exchanged as fully functioning assemblies on the filling system, e.g. on a rotating rotor. An economical and compact design can be achieved especially where these filling devices are configured as multiple filling devices, i.e. as filling devices each having at least two filling points per multiple filling device and in which the elements of the control circuit are at least in part used in common for all filling points of a multiple filling device.

As used herein, the term "containers" includes cans and bottles made from metal, glass and/or plastic, and other packages suitable for filling liquid or viscous products.

As used herein, the expression "container located in sealed position against the filling point" means that the particular container to be filled lies with its container mouth pressed tightly against the filling point or against a local seal surrounding at least one delivery opening of the filling point.

As used herein, "open-jet filling" is understood to be a method in which the filling material flows to the container to be filled in a free stream with the container either being pressed with its mouth against the filling point separated from the filling point by a gap across which it flows.

As used herein, the expressions "essentially", "in essence" or "around" mean variations from the respective exact value by ±10%, preferably by ±5% and/or variations in the form of changes insignificant for the function.

Further embodiments, advantages and possible applications of the invention arise out of the following description of embodiments and out of the figures. All of the described and/or pictorially represented attributes whether alone or in any desired combination are fundamentally the subject matter of the invention independently of their synopsis in the claims or a retroactive application thereof. The content of the claims is also made an integral part of the description.

BRIEF DESCRIPTION OF THE DRAWINGS

The invention is described in greater detail below by reference to FIGS. 1-3, which show different embodiments of filling systems for filling containers with a liquid filling-material.

DETAILED DESCRIPTION

Figure 1:
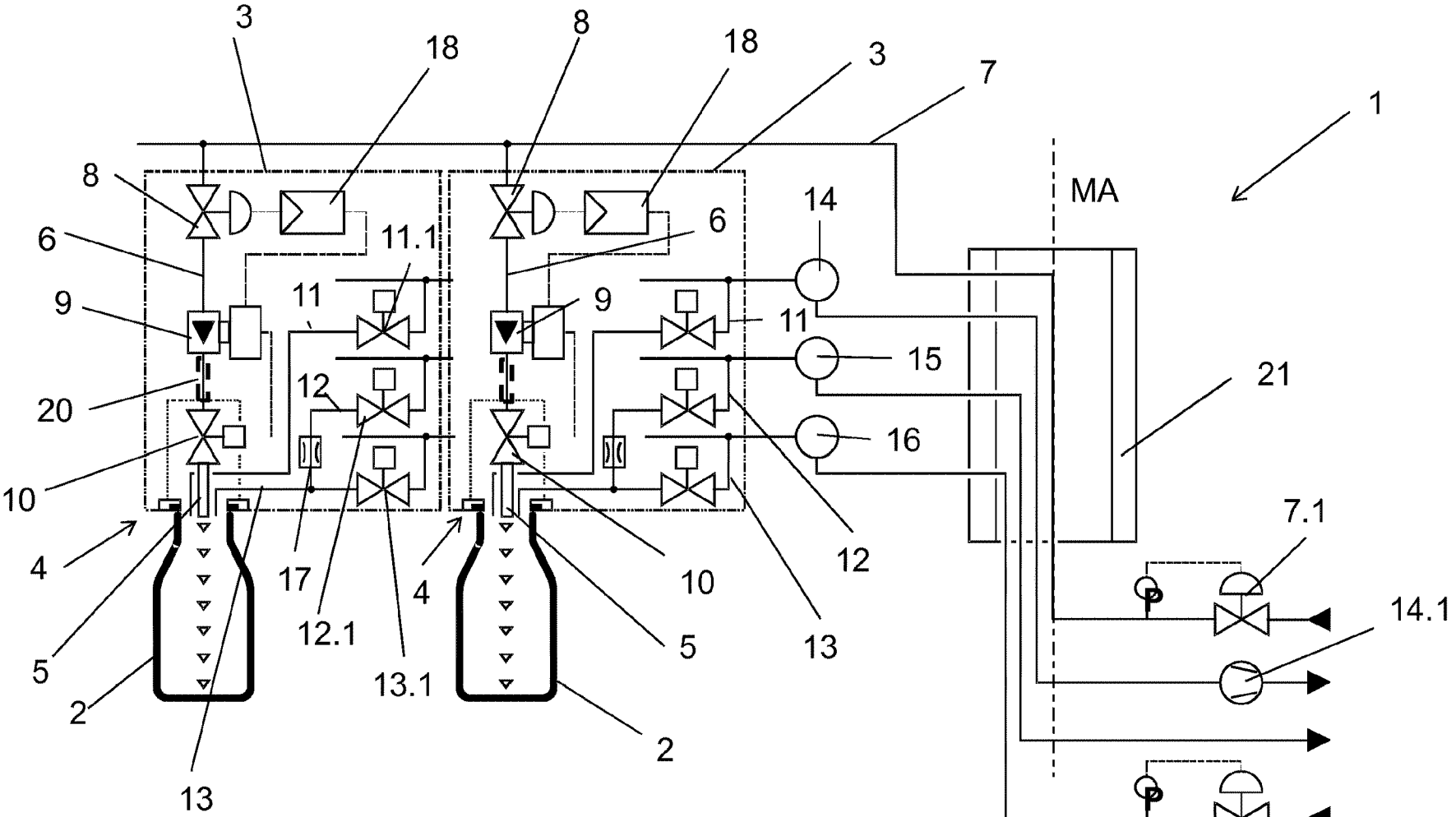

FIG. 1 shows a first filling-system 1 for pressure-filling containers 2 with filling material. The first filling-system 1 has first and second filling-blocks 3, each of which has a filling point 4. Each filling block 3 carries out controlled filling of a container 2 that is sealed against the filling point 4 through an open filling tube 5. The illustrated first filling-system 1 is one of many identical filling systems that are disposed around the circumference of a rotor that rotates about a vertical machine-axis MA.

Each filling point 4 has a product channel 6 that extends between a supply line 7 and the filling point's delivery opening. The supply line 7 is common to and supplies filling material to all the filling blocks 3. In the illustrated embodiment, the supply line 7 extends between the delivery opening and the filling tube 5.

A regulating valve 8 and a flow meter 9, both of which lie along the product channel 6, cooperate to regulate the volumetric flow of filling material through the product channel 6 either continuously or incrementally. In doing so, the flow meter 9 detects the quantity of filling material flowing through the channel 6 per unit time and supplies a corresponding electrical signal to an electronic controller or governor 18. In response, the governor 18 regulates the flow through the regulating valve 8.

A liquid valve 10 downstream of the flow meter 9 functions as an on/off valve that permits delivery of filling material when open and blocks its delivery when closed.

The regulating valve 8 thus functions as a controlled or regulated throttle that is part of a control circuit. For a given volumetric flow-rate of the filling material, a pressure difference is present at the regulating valve 8 between the pressure in the container 2 and the pressure upstream, for example in the supply line 7 or any other element of the filling system that feeds or supplies the filling material.

The first filling-system 1 includes first, second, and third controlled gas-paths 11, 12, 13 that, when the container 2 is located in sealed position against the filling point 4, are also connected to the container's interior and are also associated with each filling device 3 or each filling point 4.

A first control-valve 11.1 connects the first gas-path 11 to a first annular-channel 14. A second control-valve 12.1 connects the second gas-path 12 to a second annular-channel 15. In addition, the second gas-path 12 includes a throttle valve 17 along it. A third control-valve 13.1 connects the third gas-path 13 to a third annular-channel 16. The first, second, and third annular-channels 14, 15, 16 are provided for all the filling devices 3 and the filling points 4 in common.

A pressure regulator 7.1 connects the supply line 7 to a source of filling material. The source supplies the filling material under pressure so that a constant or essentially constant filling pressure is present in the supply line 7 during the filling operation.

During the filling operation, a vacuum pump 14.1 maintains the first annular-channel 14 at a vacuum or negative pressure. The second annular-channel 15 vents to the environment, as a result of which it carries ambient or atmospheric pressure. The third annular-channel 16 carries a preloading gas maintained at a pressure by a pressure regulator 16.1 that connects to a gas source. The preloading gas is typically an inert gas such as carbon dioxide at a preloading pressure that is slightly below the filling pressure.

The filling-material source, the gas source, and the vacuum pump are outside the rotor and do not rotate with it. The corresponding connections to the first, second, and third annular-channels 14, 15, 16 therefore extend through a rotary joint 21 between the rotor and a machine frame.

At each filling point 4, the first filling-system 1 makes possible a filling process that comprises the typical process steps described below. During the process, the container 2 that is being filled is sealed against the filling point 4. Unless otherwise indicated as open, all valves are closed.

A process controller controls the opening and closing of the first, second, and third control-valves 11.1, 12.1, 13.1 during a filling process.

The filling process begins with opening the first control-valve 11.1 to connect the container's interior to the first annular-channel 15 via the first gas-path. Since the first annular-channel 14 carries a vacuum, this evacuates the container 2.

The next step is to open the third control-valve 13.1 to connect the container's interior with the third annular-channel 16. This preloads the container's interior with the preloading gas and applies the preloading pressure to the container's interior. The steps of evacuating and purging the container can be carried out multiple times.

With the third control-valve 13.1 remaining open, the next step is to open the liquid valve 10 and, at the same time or shortly thereafter, to open the regulating valve 8. As a result of opening the liquid valve 10, the preloading pressure in the container 2 becomes present in the product line 6. This begins the filling process. During filling, the governor 18 regulates the flow through the regulating valve 8 so that it matches a pre-stored profile that is specific to the liquid filling material, the container, and the filling method. The profile is stored, for example, in the governor 18 or in a process control computer of the first filling-system 1 that interacts with the governor 18. As filling material enters the container, it displaces preloading gas from the container's interior through the still-open third control-valve 13.1. The displaced preloading gas thus returns to the third annular-channel 16.

When the flow meter 9 indicates that the required amount of filling material has entered the container 2, it sends a signal to the governor 18 to halt filling.

In a subsequent calming and relieving step, the liquid valve 10 and/or the third control-valve 13.1 remain closed so as to calm the filling material that has flowed to the container 2. After the end of a given calming period, the second control-valve 12.1 opens. This relieves pressure in the container 2 so that it matches that in the second annular-channel 15.

Figure 2:
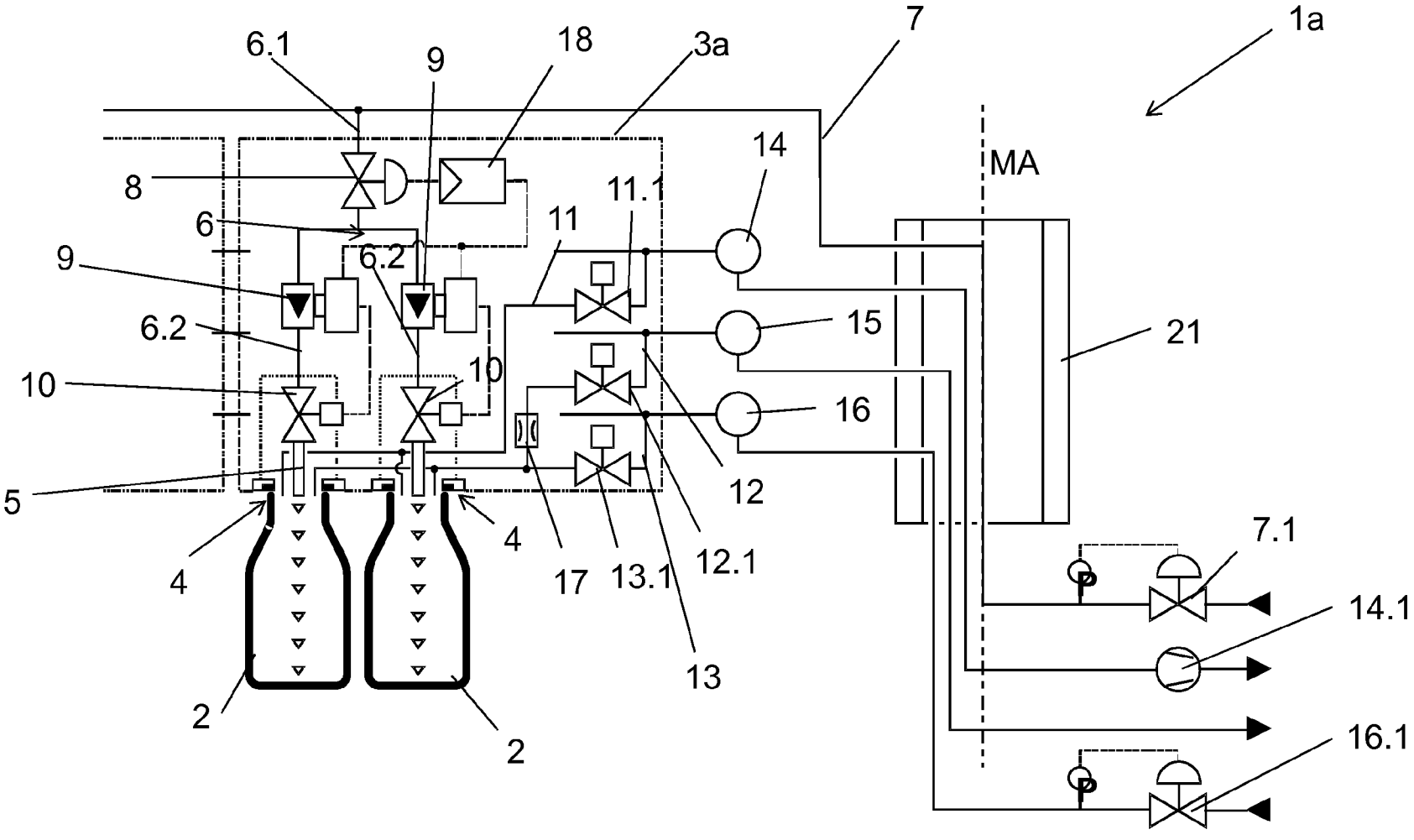

FIG. 2 shows a second filling-system 1*a* that differs from the first filling-system 1 by having two filling points 4 combined to form a dual filling element 3*a*. The first, second, and third control-valves 11.1, 12.1, 13.1 are therefore provided for both filling points 4 in common. In this configuration, the product channel 6 includes a main section 6.1 that connects the supply line 7 and two branch sections 6.2, each of which leads to a corresponding filling point 4 or local liquid valve 10. Each branch section 6.2 comprises a flow meter 9 and a liquid valve 10.

A common regulating valve 8 lies along the main section 6.1 between the branch sections 6.2 and the supply line 7. The regulating valve 8 is again part of a control circuit which comprises two flow meters 9, one for each branch section 6.2, as well as a governor 18, which controls the regulating valve 8 as a function of the target value of the filling speed and an averaged measured value calculated from the output signals of the two flow meters 9. The governor 18 controls the regulating valve 8 in the same way to achieve a target filling profile.

The process steps for using the second filling-system 1*a* are the same as those discussed in connection with the first filling-system 1. These process steps are carried out simultaneously for both the filling points 4.

Like the first filling-system 1, the second filling-system 1*a* is also configured for volumetric filling of containers 2, i.e. the liquid valves 10 are each closed as a function of the signal from the flow meter 9 that is associated with the respective filling point 4.

Figure 3:
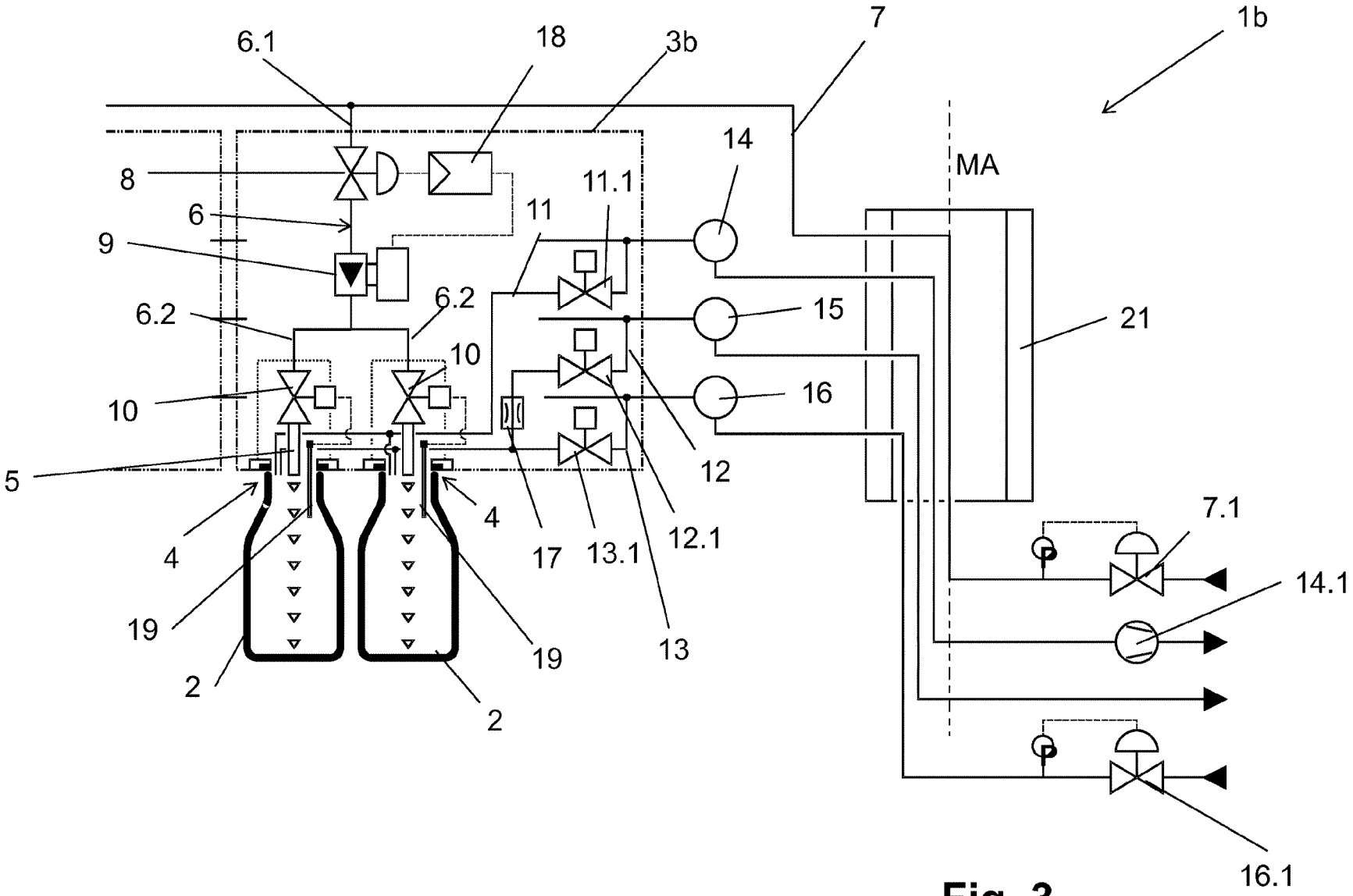

FIG. 3 shows as a third filling-system 1*b* in which once again two filling points 4 are combined to form a dual filling element. The third filling-system 1*b* differs from the second filling-system 1*a* by having a probe 19 that determines when it is time to end the filling. The probe 19 is a filling-height probe that sends an electrical signal when the level of filling material in the container 2 reaches a target value.

In the third filling-system 1*b*, the liquid valves 10 of the two filling points 4 are both provided in the branch sections 6.2 of the product channel 6, while a common flow meter 9 for both filling points 4 and a common regulating valve 8 for both filling points 4 are provided in main section 6.1. Together with the flow meter 9 and the governor 18, the regulating valve 8 again forms part of a control circuit that regulates the rate at which filing material flows into containers 2. It does so by comparing a measured value supplied by the flow meter 9 with a target value of the filling speed and controlling the regulating valve 8 to so that the actual flow rate tracks a pre-determined filling speed characteristic or profile.

The third filling-system 1*b* uses the same process steps described for the first filling-system 1 by appropriate operation of the first, second, and third control-valves 11.1, 12.1, 13.1, which are again common to both filling points 4 of this dual filling element. Except for the final closing of the liquid valves 10, which is effected for both filling points 4 individually as a function of the signal from the filling height probe 19, the other process steps again take place simultaneously.

Thus the essential core of the above described filling systems 1,1*a* and 1*b* and/or of the methods performed with these systems lies in the fact that, during the filling process, a control circuit monitors and regulates the filling speed so that at any time during the filling phase the desired filling speed is exactly maintained even though the filling material is fed under pressure to the individual filling points 4 not from a partly-filled filling-material tank but from a supply line 7 or from a tank or annular channel that is completely filled with the filling material, and that the pressure in the supply line 7 is reduced to an independent and/or freely selectable filling pressure in the container 2.

Filling systems have so far been described for filling the containers 2 that during the filling process, and in particular during the filling phase as well, are sealed against the filling point 4. However the active regulation of filling speed is also suitable for pressureless filling of containers and for open jet filling in particular. The filling points 4 of such a filling system comprise the same configuration as has been described for the first, second, and third filling-systems 1, 1*a*, 1*b*. However, the first, second, and third controlled gas-paths 11, 12, 13 and their associated first, second, and third control-valves 11.1, 12.1, 13.1 are omitted, as these are not needed for open-jet filling.

It has also been assumed above that, with the first and second filling-systems 1, 1*a* which are configured for volumetric filling, the flow meters 9 that are part of the control circuit for regulating the filling speed also supply the signal for the final closing of the filling point 4 or liquid valve 10.

In an alternative embodiment, an additional sensor system detects the quantity of filling material flowing to the container 2 for deciding when to terminate the filling phase. Examples of an additional sensor system include an additional flow meter or other measurement system, such as a weighing system.

Some embodiments feature a throttle section 20, as shown in FIG. 1, disposed in the product channel 6 upstream of the liquid valve 10. Such a throttle section 20 causes a defined and controlled reduction in filling-material pressure. In particular, the throttle section 20 is configured such that the pressure of the filling material along the throttle section 20 decreases slowly and evenly to avoid turbulent flow. Such turbulent flow is particularly undesirable for carbonated beverages because low-pressure zones in the flow can cause carbon dioxide to come out of solution When used in conjunction with open jet filling this can significantly reduce any ingress of micro-bubbles into the container to be filled when bottling carbonated drinks. The dosing of such bubbles and micro-bubble ingress into the already bottled filling material also makes it possible to significantly reduce the filling pressure towards atmospheric pressure.

Another advantage is also offered by the fact that it is possible to further reduce the weight of containers or bottles made from PET and so significantly reduce the cost of a filling plant or filling line and of any necessary cooling of the container base. Glass breakage is reduced when containers made from plastic are being filled. The consumption of preloading gas can also be reduced.

Pressure sensors with which the pressure is monitored and/or set and/or regulated to a target value are also preferably provided in the product channels 6 and/or in the product supply channel 7 and/or in the annular channels 14 and 16 and/or in the gas paths connected to these annular channels.

The invention claimed is:

1. An apparatus for filling containers with a liquid filling material, said apparatus comprising a plurality of filling blocks and a supply line that provides said liquid filing-material to each of said filling blocks, wherein each of said filling blocks in said plurality of filling blocks comprises a product channel, a filling point, a sensor, a regulating valve, a liquid valve, and a governor, wherein said sensor comprises a magnetic-inductive flowmeter, wherein controlled container-filling takes place at said filling point, wherein said product channel is connected to said supply line, wherein said regulating valve comprises a controlled throttle that dynamically regulates flow velocity in said product channel to compensate for real-time changes in pressure, wherein said liquid valve is downstream from said regulating valve, and wherein said governor compensates for pressure fluctuations by receiving, from said sensor, a signal indicative of measured flow velocity and controlling said regulating valve based on a comparison between said measured flow velocity and a target flow velocity, whereby filling material flows into said container through said liquid valve with a flow velocity that is regulated by control of said regulating valve in response to an extent to which said signal provided by said sensor indicates a measured flow velocity that differs from said target flow velocity.

2. The apparatus of claim 1, wherein, at each filling block in said plurality of filling blocks, said filling block's governor is further configured to cause a speed at which a container is filled at said filling block to be independent of a difference between a level of liquid filling-material in a filling-material tank and levels of said filling points in said filling blocks by varying a volumetric flow rate through said liquid valve.

3. The apparatus of claim 1, wherein, at each filling block in said plurality of filling blocks, said filling block's governor is further configured to cause a volumetric flow rate measured by said filling block's sensor to follow a time-varying function in which different volumetric flow rates occur at different times.

4. The apparatus of claim 1, wherein, at each filling block in said plurality of filling blocks, said filling block's governor is further configured to begin filling a container at said filling block's filling point at a slow flow rate and to increase said flow rate as said containers fill.

5. The apparatus of claim 1, wherein, at each of said filling blocks, said filling block's regulating valve and said filling block's sensor, both of which lie along said filling block's product channel, cooperate to continuously regulate volumetric flow of said filling material through said filling block's product channel.

6. The apparatus of claim 1, wherein, at each filling block in said plurality of filling blocks, said filling block's regulating valve and said filling block's sensor, both of which lie along said filling block's product channel, cooperate to continuously regulate volumetric flow of said filling material through said filling block's product channel.

7. The apparatus of claim 1, wherein, at each filling block in said plurality of filling blocks, said filling block's regulating valve comprises a controlled throttle such that a pressure difference exists between pressure in said container and pressure upstream of said regulating valve.

8. The apparatus of claim 1, further comprising a vacuum pump, a pressure regulator, a first annular channel that is maintained at a negative pressure by said vacuum pump, a second annular channel that vents to the environment, and a third annular channel that carries a pressurized pre-loading gas whose pressure is controlled by said pressure regulator, wherein said first, second, and third annular channels are provided in common for all of said filling blocks in said plurality of filling blocks, wherein each of said filling blocks in said plurality of filling blocks comprises first, second, and third controlled gas-paths, first, second, and third control valves, and a throttle valve, wherein, when a container is located in a sealed position against said filling block's filling point, said first, second, and third controlled gas-paths are connected to said container's interior, wherein said first control-valve connects said first gas-path to said first annular-channel, wherein said second control-valve connects said second gas-path to said second annular-channel, and wherein said third control-valve connects said third gas-path to said third annular-channel, and wherein said throttle valve is along said second gas-path.

9. The apparatus of claim 1, wherein at each filling block in said plurality of filling blocks, said filling block's governor is further configured to permit a filling pressure at a container being filled at said filling block to be freely selectable and to control said flow velocity independently of a pressure difference across said regulating valve.

10. The apparatus of claim 1, wherein said regulating valve is arranged in said product channel such that filling material flows through said regulating valve, wherein said sensor is arranged in said product channel downstream of said regulating valve to measure flow rate through said regulating valve and to provide a signal to said governor, and wherein said governor controls said regulating valve to conform to said target flow velocity based at least in part on said signal.

11. The apparatus of claim 1, wherein said regulating valve, which is arranged in said product channel, is configured to close said product channel upon completion of delivery of said filling material into said container.

12. The apparatus of claim 1, wherein said liquid valve is a shut-off valve that closes said product channel to prevent further delivery of filling material upon completion of container filling and wherein, as a result of being regulated by said governor, flow through said product channel conforms to said target flow velocity.

13. The apparatus of claim 1, wherein said governor is configured to operate said regulating valve to cause said filling pressure to be a freely selectable pressure that is lower than said supply-line pressure and independent of said supply-line pressure.

14. The apparatus of claim 1, further comprising a probe that senses filling-material level in said container and provides a signal when a level of filling material in the container reaches a target value, wherein said signal causes said liquid valve to close.

15. The apparatus of claim 1, further comprising a throttle section along said product channel downstream of said regulating valve and upstream of said delivery opening and wherein said throttle section is configured such that the pressure of the filling material along the throttle section decreases according to a predetermined profile, thereby avoiding turbulent flow.

16. The apparatus of claim 1, wherein said governor is configured to cause said regulating valve to maintain said flow velocity at a constant value.

17. The apparatus of claim 1, wherein said governor is configured to cause said regulating valve to control flow velocity into said container so as to follow a predetermined velocity profile.

18. The apparatus of claim 1, wherein said governor is configured to select said target flow velocity as a function of said filling material.

19. The apparatus of claim 1, wherein said governor is configured to select said target flow velocity as a function of said container.

20. The apparatus of claim 1, wherein said governor is configured to select said target flow velocity as a function of a filling method to be used by said filling point to fill said container.

21. The apparatus of claim 1, wherein said governor is configured to regulate said regulating valve based on a profile that is specific to the liquid filling material, the container being filled, and the method of filling.

22. The apparatus of claim 1, wherein, in each of said filling blocks, said filling point is one of a plurality of filling points, wherein said liquid valve is one of a corresponding plurality of liquid valves, each of which is associated with one of said filling points, and wherein said sensor is one of a plurality of sensors, each of which is associated with one of said filling points, wherein said product channel comprises a main section that connects to said supply line, wherein said regulating valve is between said supply line and said sensors, wherein said filling block's regulating valve regulates flow to each of said filling points, wherein each of said filling block's sensors is disposed downstream of said regulating valve and upstream of a corresponding one of said liquid valves, and wherein each of said filling block's sensors measures flow towards a corresponding one of said filling points.

23. The apparatus of claim 1, wherein, in each of said filling blocks, said filling point is one of a plurality of filling points, wherein said liquid valve is one of a corresponding plurality of liquid valves, each of which is associated with one of said filling points, wherein said product channel comprises a main section that connects to said supply line, wherein said regulating valve and said sensor are along said main section with said sensor downstream of said regulating valve, wherein said filling block's regulating valve regulates flow to each of said filling points, and wherein said sensor measures flow through said regulating valve.

24. The apparatus of claim 1, further comprising a pressure regulator that connects said supply line to a source of pressurized filling material and a rotor having a periphery on which filling blocks from said plurality of filling blocks are disposed, wherein said source of pressurized filling material is outside of said rotor.

25. The apparatus of claim 1, wherein, at each filling block in said plurality of filling blocks, said filling block's governor is further configured to cause a speed at which a container is filled at said filling block to be independent of pressure in said supply line.

26. A method comprising using plural filling blocks to fill containers, wherein said filling blocks receive liquid filling-material from a common supply line, wherein each of said filling blocks comprises a product channel that receives filling material from said supply line, a magnetic-inductive flowmeter that provides a signal indicative of measured flow velocity, a regulating valve that comprises a controlled throttle that dynamically regulates flow velocity in said product channel to compensate for real-time changes in pressure, a liquid valve downstream of said regulating valve, and a filling point at which controlled container-filling takes place, wherein said method comprises, at each of said filling blocks, opening said filling block's liquid valve, opening said filling block's regulating valve concurrently with or after having opened said liquid valve, sensing flow velocity of said filling material, comparing said sensed flow velocity with a target flow velocity, and using said filling block's regulating valve to regulate said sensed flow velocity such that said sensed flow velocity is independent of a pressure difference between a supply-line pressure and a filling pressure in said container.

27. The method of claim 26, further comprising applying a preloading pressure to said container, opening said regulating valve after said container has been preloaded, and applying said preloading pressure to a portion of said product line.

28. The method of claim 26, further comprising opening said liquid valve between twenty and eighty milliseconds after having opened said regulating valve.

29. The method of claim 26, wherein using said regulating valve to regulate said flow velocity comprises compensating for pressure fluctuations.

* * * * *